US005481442A

United States Patent [19]

Dickie et al.

[11] Patent Number: 5,481,442

[45] Date of Patent: Jan. 2, 1996

[54] NIGHT LIGHT COVER PLATE ASSEMBLY FOR ELECTRIC WALL OUTLET

[75] Inventors: Robert G. Dickie, Newmarket; Larry W. Gatien, Burlington; Suzanne J. Wiltshire, Brantford, all of Canada

[73] Assignee: Paige Innovations Inc., King City, Canada

[21] Appl. No.: 243,014

[22] Filed: May 16, 1994

[51] Int. Cl.[6] ..... F21V 33/00

[52] U.S. Cl. ..... 362/95; 362/226; 362/290; 439/373

[58] Field of Search ..... 362/95, 147, 226, 362/290, 367, 368, 354; 439/135, 350, 373, 489, 536

[56] References Cited

U.S. PATENT DOCUMENTS

| | | | |
|---|---|---|---|
| Re. 24,393 | 11/1957 | McCarthy | 362/95 |
| 3,739,226 | 6/1973 | Seiter et al. | 362/20 |
| 4,000,405 | 12/1976 | Horwinski | 362/95 |
| 4,343,032 | 8/1982 | Schwartz | 362/226 |
| 4,915,638 | 4/1990 | Domian | 439/142 |
| 5,280,135 | 1/1994 | Berlin et al. | 174/67 |

*Primary Examiner*—Ira S. Lazarus
*Assistant Examiner*—Sara Sachie Raab

[57] ABSTRACT

A night light integral with a low profile cover plate assembly for electrical wall outlets utilizes two parts, a wall plate and a cover plate. The wall plate has a flat rear panel which is attached to the wall outlet, lies against the wall and includes peripheral lips holding a plurality of detent ridges. The cover plate includes the night light assembly which, in turn, includes power blades engaging the slots of the wall outlet to energize a night light bulb. Light escapes from underneath the cover plate through clear plastic lenses filling openings in the cover plate. Snap action projections on the inner surfaces of the cover plate periphery engage the retention ridges on the outer surfaces of the wall plate to ensure that the cover plate night light is attached to the wall plate by forces other than simply the friction of the power blades in the outlet slots. The cover plate may simultaneously used to cover a low profile plug in the other outlet slots of a standard duplex wall outlet.

9 Claims, 1 Drawing Sheet

NIGHT LIGHT COVER PLATE ASSEMBLY FOR ELECTRIC WALL OUTLET

TECHNICAL FIELD

This invention relates to night lights and, more particularly, to a night light integral to an electric outlet cover plate assembly.

BACKGROUND OF THE INVENTION

Prior art night lights designed to be plugged directly into electric wall outlets have one major problem. The maximum and minimum blade friction allowable by electric equipment regulatory authorities (e.g., UL and CSA) is specified to permit reasonable convenience for the user in plugging and unplugging the blades from standard electric wall outlets. Unfortunately, however, this ease in removing the night light from the outlet increases its safety hazard. Babies and young children are attracted to lighted objects, particularly objects accessible at eye level near the floor. Moreover, night lights are generally larger than normal plugs, thus providing a large gripping surface for crawling infants and children. It is therefore possible for infants and children to partially remove the night light from the outlet and insert their small fingers into contact with the live power blades, exposing themselves to severe electric shock.

One of the present applicants, R. G. Dickie, has filed a patent application, Ser. No. 08/220,302 filed Mar. 28, 1994, on a cover plate assembly for electric outlets which uses a wall plate to be screwed to the outlet itself and a cover plate attached to the wall plate by ridges on the outer periphery of the cover plate which engage mating ridges on the outer periphery of the wall plate by snap action. The cover plate engages the wall plate with a significantly greater force than the normal blade friction of an electric plug, yet is readily removable by a determined pull on the cover plate.

SUMMARY OF THE INVENTION

In accordance with the illustrative embodiment of the present invention, a night light is built into the cover plate of a two-part, wall plate/cover plate assembly. The friction afforded by the standard power blades used to deliver power to the night light is therefore not the only force tending to retain the night light engaged in the outlet. The snap action retention ridges on the periphery of the cover plate provide an additional force tending to keep the night light plugged into the outlet. Moreover, the cover plate provides a smooth, low profile surface with little or no finger holds for inquisitive children to grasp. Finally, if the cover plate snap action ridges on the cover plate are disengaged from the wall plate, the width of the cover plate shields the live power blades until the power blades are safely out of the wall outlet.

One significant advantage of the night light cover plate assembly of the present invention is the possibility of a very low profile, adding to the physical appearance of the night light as well as the additional safety against shock hazards.

In accordance with one feature of the present invention, the night light occupies only one half of the cover plate interior leaving the other half to act as a cover plate for a low profile electric plug as taught in the aforementioned Dickie patent application.

The present invention thus provides a night light which engages the wall outlet with retention latches as well as the friction of the power blades. The night light must therefore be disengaged from the latches before removal of the night light can occur, significantly adding to the protection against electrical shock.

BRIEF DESCRIPTION OF THE DRAWINGS

A complete understanding of the present invention may be gained by considering the following detailed description in conjunction with the accompanying drawings, in which.

To facilitate reader understanding, identical reference numerals are used to designate elements common to the figures.

DETAILED DESCRIPTION

Figure 1:
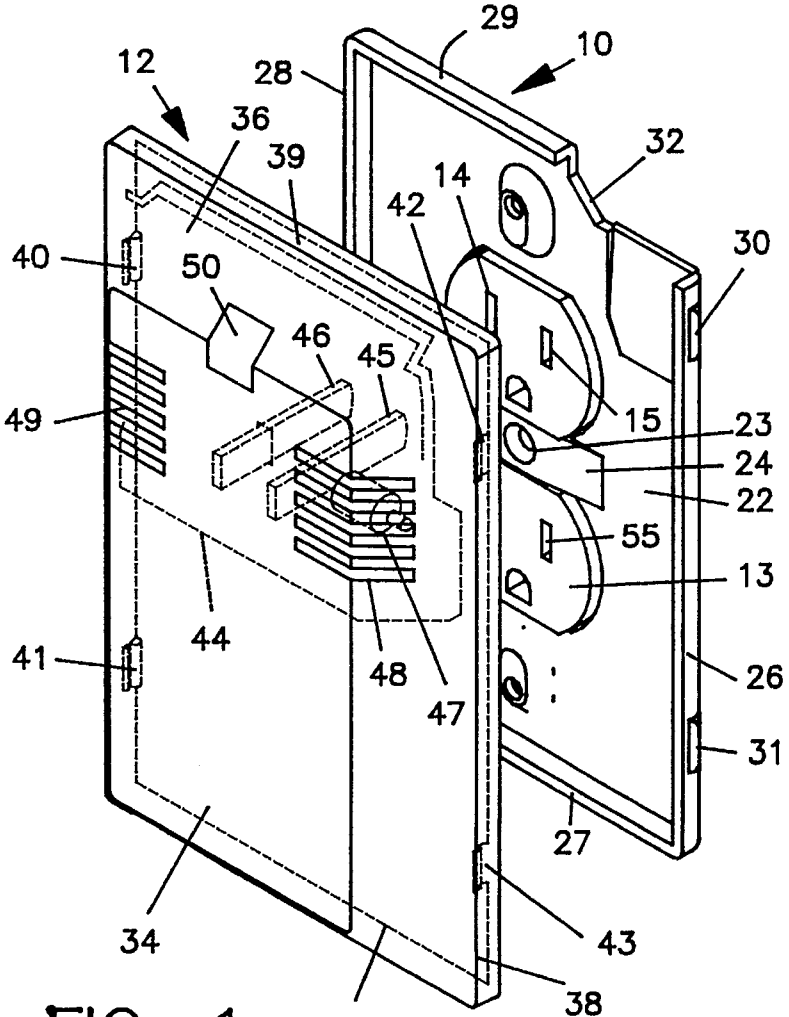
FIG. 1 shows a perspective exploded view of a low profile two part wall outlet cover plate assembly including an integral night light in accordance with the present invention.

Referring more particularly to FIG. 1, there is shown a perspective exploded view of a night light assembly comprising a wall plate 10 and a cover plate 12. Wall plate 10 and cover plate 12 are preferably fabricated by an injection molding process using any rigid plastic material such as NORYL® available from the General Electric Company.

Wall plate 10 comprises a rectangular flat rear or inner panel 22 which is attached to the standard duplex outlet assembly 13 by a screw through a central hole 23. A similar wall plate could be fabricated for any other style of outlet such as, for example, a DECORA outlet, and serve as an attachment plate for cover plate 12. In FIG. 1, the area in the vicinity of hole 23 is reinforced by ramp-shaped fillets such as fillet 24. Lips 26, 27, 28 and 29 extend at right angles from rear panel 22 away from the wall in which outlet assembly 13 is embedded. It will be noted that the wall plate 10 construction is opposite to the normal wall plate in that the lips extend away from rather than toward the wall in which the wall outlet assembly is embedded. This topology minimizes the protrusion of the wall plate 10 from the wall and, at the same time, maximizes the interior volume under the cover plate 12 for containing the night light assembly in cover plate 12. A plurality of triangular retention ridges or detents, like ridges 30 and 31, are located on the outer surfaces of two or more of lips 26–29. As will be described in detail hereinafter, the triangular detent ridges 30–31 cooperate with latch projections on the interior edges of cover plate 12 to latch cover plate 12 to wall plate 10.

Cover plate 12 is shaped like a truncated rectangular pyramid having a central flat outer or exterior panel 34 with four sloping edge panels similar to edge panels 35 and 36, sloping toward the wall plate 10. The outer edges of the sloping edge panels similar to edge panels 35 and 36 terminate in lips similar to lips 38 and 39 extending perpendicularly to and away from central panel 34. The rectangular opening formed by the lips similar to lips 38–39 on cover panel 12 is sufficiently large to tightly enclose the outer lips 26–29 of wall plate 10. The interior surfaces of the lips similar to lips 38 and 39 support retainer snap action projections 40 through 43 (better seen in FIG. 2) which register with and engage detent ridges 30 and 31 on the periphery of wall plate 10 to latch cover plate 12 to wall plate 10. As was described in more detail in the aforementioned co-pending application of R. G. Dickie, Ser. No. 08/220,302.

Figure 3:
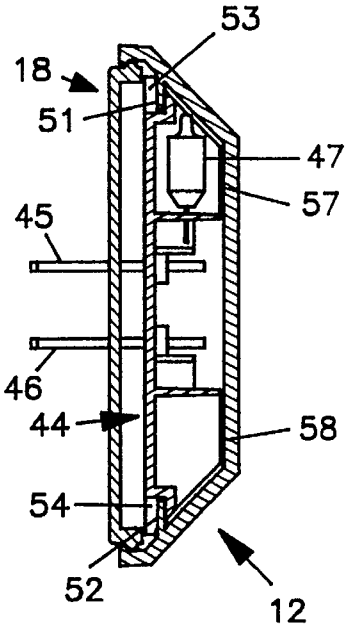
FIG. 3 shows a cross sectional view of the cover plate of FIGS. 1 and 2 in the vicinity of the night light integral in the cover plate.

In accordance with the present invention, a night light assembly 44 (shown in dotted lines in FIG. 1) occupies a portion of the interior space of cover plate 12. As can be better seen in FIGS. 2 and 3, night light assembly 44 includes a pair of power blades 45 and 46 which engage the slots 14 and 15 in wall outlet 13 to provide power for a night light neon bulb 47 (FIG. 3). Bulb 47 is therefore illuminated whenever blades 45 and 46 engage the power source in slots 14 and 15 of outlet 13. Bulb 47 is preferably a tow type long life neon bulb which operates cool and is normally expected to last the useful life of the night light assembly 44. Cover plate 12 includes a plurality of slots 48 in the region of bulb 47 to allow the light from bulb 47 to escape from cover plate 12. Indeed, slots 49 on the other side of cover plate 12 can be used to permit light from a second bulb, not shown in FIG. 3, to escape from under cover plate 12. Cover plate 12 also includes an opening 50 (which may be filled with a clear plastic window) which can be used to admit light to the interior of night light assembly 44. The interior of assembly 44 may include a light sensor (not shown in the present application) under opening 50 which can be used to control the activation of bulb 47 as is common in night lights plugged into wall outlets.

Figure 2:
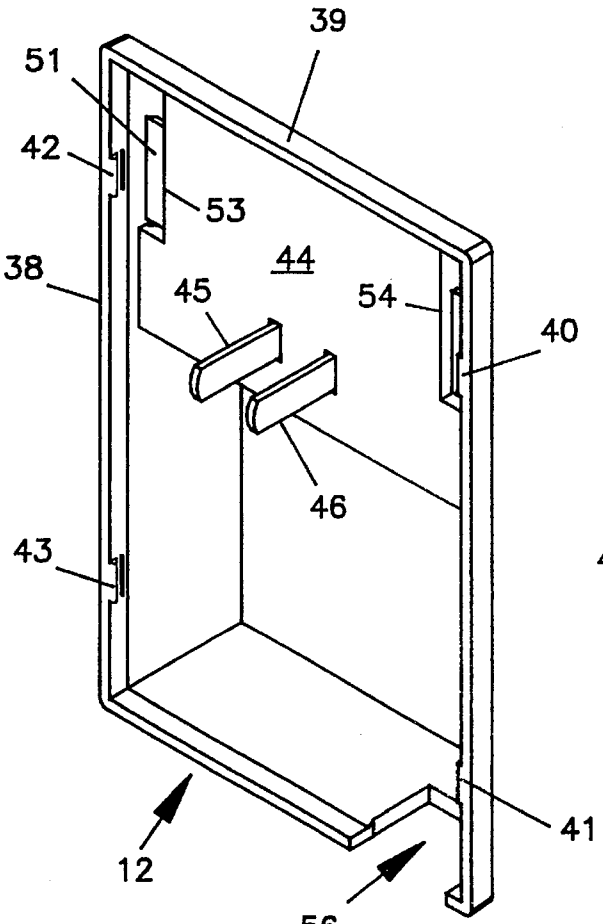
FIG. 2 shows a perspective view of the back side of the cover plate a frontal view of which is shown in FIG. 1.

As can be best seen in FIGS. 2 and 3, cover plate 12 includes a pair of detents 51 and 52 which cooperate with recesses 53 and 54 in night light assembly 44 to hold assembly 44 in place in the interior of cover plate 12. The cover plate 12 covers the entire electric outlet 13 and thus serves to protect the second outlet slob (e.g., slot 55) from insertion of objects by infants and small children and thereby protecting against the electric shock safety hazard. The cover plate 12 thus serves the double function of providing a night light while at the same time protecting the outlet from infants and small children.

As can be seen in FIGS. 1 and 2, night light assembly 44 occupies less than one-half of the interior of cover plate 12. In accordance with one feature of the present invention, cover plate 12 can therefore simultaneously be used to enclose a low profile electric plug plugged into the lower slob (including slot 55, FIG. 2) of outlet 13. In FIG. 2, a notch 56 in cover plate 12 accommodates the exit of the plug cord from under cover plate 12. As taught in the aforementioned co-pending application Ser. No. 08/220,302, opening 56 may be filled with a break-away plug to cover the opening 56 when cover plate 12 is not used to cover a low profile plug. One low profile plug suitable for use with the night light cover plate of the present invention is disclosed in U.S. Pat. No. 4,927,376, granted May 22, 1990, to R. G. Dickie.

In the cross sectional view of night light assembly 44 shown in FIG. 3, it can be seen that bulb 47 is enclosed in a clear plastic shell 57 which may have molded therein a plurality of protruding clear plastic lenses which extend into and essentially fill slots 48 in cover plate 12. These lens protrusions are designed not only to fill slots 48 to assist in conducting light from bulb 47 to the exterior of cover plate 12, but also provides an essentially flat and flush outer surface for cover plate 12, removing any uneveness in the outer surface of cover plate 12 which might serve as finger holds for infants to grasp cover plate 12. These projecting lenses filling slots 48, as well as the clear plastic window in opening 50, fill their respective openings sufficiently tightly to prevent pins or saliva from infants and young children to penetrate cover plate 12 and damage the night light assembly 44 and present a shock hazard to the infant or child. A clear plastic cover 58 on the other side of night light assembly 44 serves a similar purpose for a second bulb which might be used under slots 49 in cover plate 12. The details of the wiring circuit in the interior of night light assembly 44 is believed to be obvious (and may comprise printed circuitry on the interior surface of assembly 44) and is not shown in detail here.

What is claimed is:

1. A night light for a standard duplex socket electric wall outlet having two separate sockets, said night light comprising a night light assembly including an electric bulb and a pair of power blades, a cover plate for covering said wall outlet, said night light assembly being integral with said cover plate and mounted in a first portion of the interior of said cover plate such that said power blades engage one socket of said two separate sockets of said duplex socket outlet without interfering with the insertion of an electric plug into the other socket of said outlet, means for latching said cover plate to said wall outlet, and means for accepting a low profile plug inserted into said other outlet of said standard duplex outlet under a second portion of the interior of said cover plate.

2. The night light assembly according to claim 1 further comprising light conducting slots in said cover plate in the vicinity of said bulb.

3. The night light assembly according to claim 2 further comprising clear plastic lenses for filling said slots to conduct light through said cover plate, the outer surface of said lenses being flush with the outer surface of said cover plate.

4. The night light assembly according to claim 1 further comprising an opening in said cover plate for accommodating a light sensor under said cover plate.

5. A night light assembly for an electric wall outlet comprising a wall plate for mounting directly on said electric wall outlet and having a first peripheral latch mechanism, and a cover plate including an integral night light with power blades engaging said wall outlet and having a second peripheral latch mechanism for engaging said first peripheral latch mechanism.

6. The night light assembly according to claim 5 further comprising light conducting slots in said cover plate.

7. The night light assembly according to claim 6 further comprising clear plastic lenses for filling said slots to conduct light through said cover plate, the outer surface of said lenses being flush with the outer surface of said cover plate.

8. The night light assembly according to claim 5 further comprising an opening in said cover plate for accommodating a light sensor under said cover plate.

9. The night light assembly according to claim 5 wherein said night light assembly covers only one outlet of a standard duplex outlet, and means for accepting a low profile plug inserted into the other outlet of said standard duplex outlet under a portion of said cover plate.

* * * * *